US010281853B1

(12) United States Patent
Yamada

(10) Patent No.: US 10,281,853 B1
(45) Date of Patent: May 7, 2019

(54) FIXING DEVICE AND IMAGE FORMING APPARATUS

(71) Applicant: Konica Minolta, Inc., Tokyo (JP)

(72) Inventor: Takashi Yamada, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/141,145

(22) Filed: Sep. 25, 2018

(30) Foreign Application Priority Data

Oct. 12, 2017 (JP) ..... 2017-198768

(51) Int. Cl.
*G03G 15/20* (2006.01)

(52) U.S. Cl.
CPC ..... *G03G 15/2028* (2013.01); *G03G 15/2053* (2013.01); *G03G 15/2064* (2013.01)

(58) Field of Classification Search
CPC ..... G03G 15/2028; G03G 15/2053; G03G 15/2064
See application file for complete search history.

(56) References Cited

U.S. PATENT DOCUMENTS

2002/0061198 A1* 5/2002 Sameshima ..... G03G 15/2064 399/68
2013/0243463 A1* 9/2013 Kanai ..... G03G 15/2039 399/67

FOREIGN PATENT DOCUMENTS

JP H05-330699 A 12/1993

* cited by examiner

*Primary Examiner* — Sandra Brase
(74) *Attorney, Agent, or Firm* — Lucas & Mercanti, LLP

(57) ABSTRACT

A fixing device includes a fixing belt, a distortion detection section that detects distortion in which a magnitude of bending at one side edge in a width direction of a recording medium entering a fixing nip is different from a magnitude of bending at the other side edge in the width direction, a conveying speed changer that changes a conveying speed of the fixing belt in the width direction, and a hardware processor that controls the conveying speed changer such that the conveying speed of the fixing belt in the width direction is changed to eliminate the distortion in a case where the distortion is detected.

10 Claims, 11 Drawing Sheets

FIXING DEVICE AND IMAGE FORMING APPARATUS

CROSS REFERENCE TO RELATED APPLICATIONS

Japanese Patent Application No. 2017-198768 filed on Oct. 12, 2017, including description, claims, drawings, and abstract the entire disclosure is incorporated herein by reference in its entirety.

BACKGROUND

Technological Field

The present invention relates to a fixing device and an image forming apparatus.

Description of Related Art

Conventionally, as a fixing device used in an electrophotographic image forming apparatus such as a copier, a printer, and a facsimile, there has been known a heat roller system fixing device that includes an upper-side pressure roller having a heat source inside thereof, and a lower-side pressure roller for forming a fixing nip by being pressed against the upper-side pressure roller, the heat roller mode fixing device in which a recording medium, on which an unfixed toner image is formed, is heated while being held and conveyed by the upper and lower side pressure rollers at the time of printing so that the toner image is fixed onto the recording medium.

Further, for example, there has been known a belt-type fixing device that includes a heating roller having a heat source inside thereof, an upper-side pressure roller, a fixing belt wound around those rollers, and a lower-side pressure roller for forming a fixing nip by being pressed against the upper-side pressure roller via the fixing belt, the belt-type fixing device in which a recording medium is heated via the fixing belt while being held and conveyed by the fixing belt and the lower-side pressure roller at the time of printing so that a toner image is fixed onto the recording medium.

Here, a transfer device for transferring a toner image formed on a surface of a photoconductor to a recording medium is disposed upstream of the fixing nip in the recording medium conveying direction. In the transfer device, there are disposed a driving roller drivingly connected to a motor, a driven roller disposed being spaced apart from the driving roller, a transfer belt wound around those rollers, and a transfer roller disposed facing the driven roller via the transfer belt. The recording medium to which the toner image is transferred is conveyed from the transfer roller to the fixing nip.

There has been known a paper sheet conveying device that includes a plurality of rollers disposed on the same axis and reorients a recording medium by 90 degrees by changing rotation speeds between the plurality of rollers (e.g., see Japanese Patent Application Laid-Open No. H05-330699).

In a case where a distance from a transfer roller to a fixing nip of a fixing device is shorter than a length of a recording medium in a conveying direction, when a leading edge of the recording medium enters the fixing nip in a tilted state, a conveying speed of the recording medium by the fixing nip becomes large at one end portion in a width direction of the recording medium (direction orthogonal to the conveying direction) and becomes small at the other end portion in the width direction so that the conveying speed of the recording medium in the width direction does not become uniform. Meanwhile, since the conveying speed of the recording medium by the transfer roller is uniform in the width direction, distortion in which the other side edge in the width direction of the recording medium bends in a loop shape (one-sided loop) occurs. In a case where an axis of the transfer roller and an axis of the fixing roller are not in parallel with each other, the conveying direction of the recording medium with respect to the transfer roller is different from the conveying direction of the recording medium with respect to the fixing roller. This causes distortion. This distortion contributes to an image defect such as an image shift, for example.

Note that the paper sheet conveying device disclosed in Japanese Patent Application Laid-Open No. H05-330699 intends to reorient the recording medium and does not intend to eliminate the distortion of the recording medium. It is difficult to eliminate the distortion of the recording medium according to the configuration of the paper sheet conveying device described above.

SUMMARY

An object of the present invention is to provide a fixing device and an image forming apparatus capable of eliminating distortion of a recording medium.

In order to realize at least one of the above objects, a fixing device reflecting an aspect of the present invention includes:

a fixing belt;

a distortion detection section that detects distortion in which a magnitude of bending at one side edge in a width direction of a recording medium entering a fixing nip is different from a magnitude of bending at the other side edge in the width direction;

a conveying speed change section that changes a conveying speed of the fixing belt in the width direction relative to the recording medium; and a hardware processor that controls the conveying speed change section such that the conveying speed of the fixing belt in the width direction is changed to eliminate the distortion in a case where the distortion is detected.

Also, an image forming apparatus reflecting an aspect of the present invention includes the fixing device.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
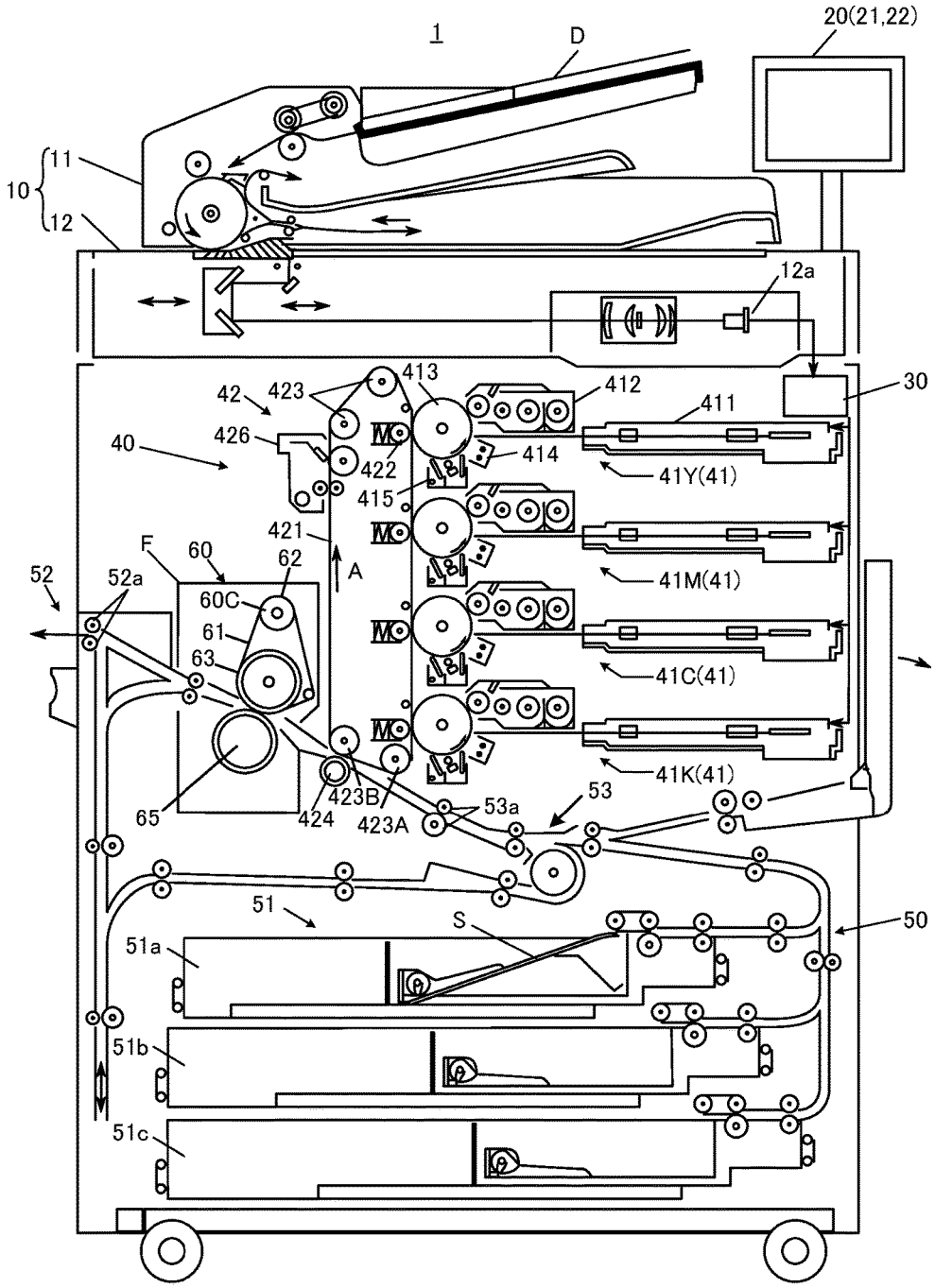
FIG. 1 is a diagram schematically illustrating an entire configuration of an image forming apparatus according to an embodiment of the present invention.
Figure 2:
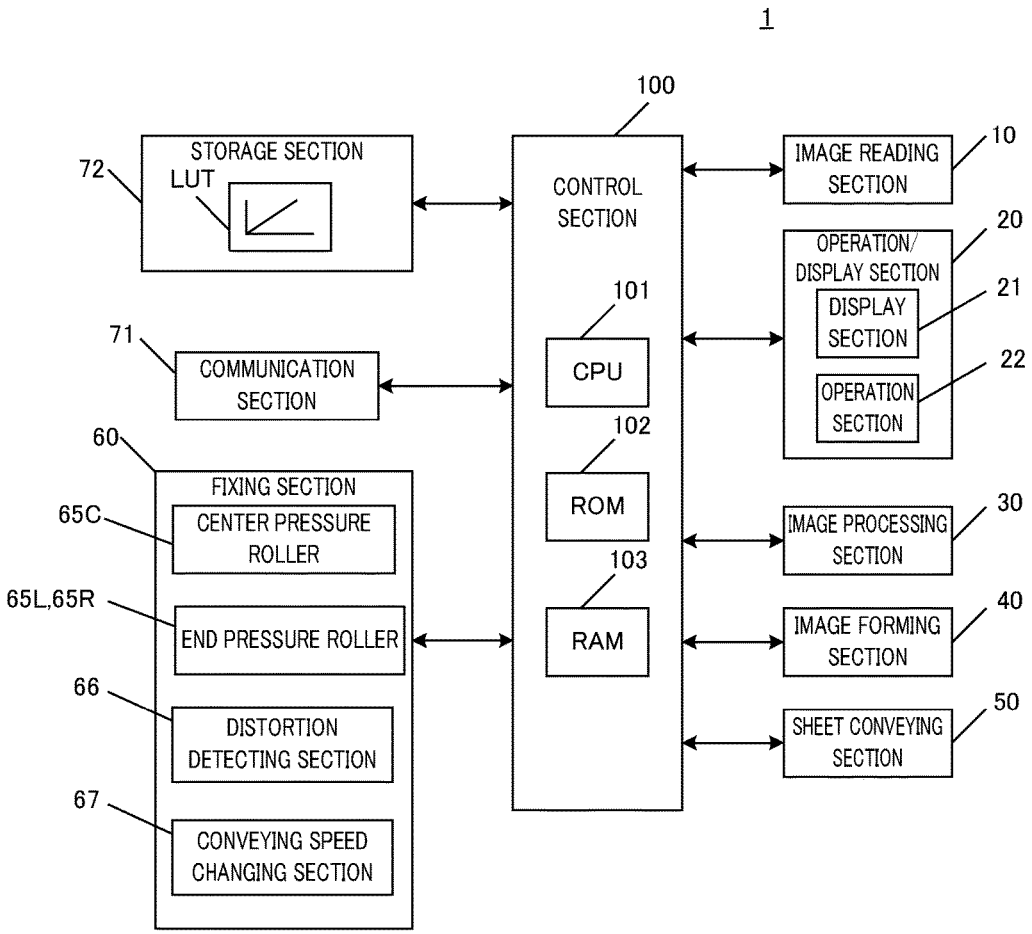
FIG. 2 is a diagram illustrating a main section of a control system of the image forming apparatus according to the present embodiment.

Hereinafter, the present embodiment will be described in detail with reference to the accompanying drawings. FIG. 1 is a diagram schematically illustrating an entire configuration of an image forming apparatus 1 according to an embodiment of the present invention. FIG. 2 is a diagram illustrating a main section of a control system of the image forming apparatus 1 according to the present embodiment. An image forming apparatus 1 illustrated in FIGS. 1 and 2 is an intermediate transfer color image forming apparatus using a technique of the electrophotographic process. That is, the image forming apparatus 1 transfers respective color toner images of yellow (Y), magenta (M), cyan (C), and black (K) formed on photoconductor drums 413 to an intermediate transfer belt 421 (primary transfer), superimposes the toner images of the four colors on the intermediate transfer belt 421, and transfers it to a paper sheet S (recording medium), thereby forming an image (secondary transfer).

In addition, the image forming apparatus 1 employs a tandem system in which the photoconductor drums 413 corresponding to the four colors of Y, M, C, and K are disposed in series in the running direction of the intermediate transfer belt 421, and the toner images of the respective colors are successively transferred to the intermediate transfer belt 421 in a single procedure.

As illustrated in FIG. 2, the image forming apparatus 1 includes image reading section 10, operation/display section 20, image processing section 30, image forming section 40, sheet conveying section 50, fixing section 60, and control section 100.

Control section 100 includes central processing unit (CPU) 101, read-only memory (ROM) 102, random access memory (RAM) 103, and the like. CPU 101 reads, from ROM 102, a program corresponding to processing details, loads the program into RAM 103, and performs, in cooperation with the loaded program, centralized control on operations of respective blocks of the image forming apparatus 1. During this step, various data stored in storage section 72 are referred to. Storage section 72 includes, for example, a nonvolatile semiconductor memory (what is called flash memory) and/or a hard disk drive.

Control section 100 transmits/receives, via communication section 71, various data to/from an external device (e.g., personal computer) connected to a communication network such as a local area network (LAN) and a wide area network (WAN). For example, control section 100 receives image data (input image data) transmitted from the external device, and operates to form an image on the paper sheet S on the basis of the image data. Communication section 71 includes, for example, a network interface card such as a LAN card.

Image reading section 10 includes auto document feeder (ADF) 11, document image scanner 12, and the like.

Auto document feeder 11 conveys, with a conveying mechanism, document D placed on a document tray and sends it to document image scanner 12. Auto document feeder 11 can continuously and simultaneously read images on multiple documents D (including images on both sides thereof) placed on the document tray.

Document image scanner 12 optically scans a document conveyed from the auto document feeder 11 onto a contact glass or a document placed on a contact glass, and images light reflected from the document on a light receiving surface of change coupled device (CCD) sensor 12*a*, thereby reading a document image Image reading section 10 generates input image data on the basis of a result of the reading performed by the document image scanner 12. The input image data is subject to predetermined image processing in image processing section 30.

Operation/display section 20 includes, for example, a touch panel-type liquid crystal display (LCD), and functions as display section 21 and operation section 22. Display section 21 displays various operation screens, image conditions, operation conditions of each function, and the like in accordance with a display control signal input from control section 100. Operation section 22 includes various operation keys such as a numeric keypad and a start key, receives various input operation from a user, and outputs an operation signal to control section 100.

Image processing section 30 includes, for example, a circuit that performs digital image processing on input image data in accordance with default settings or user settings. For example, image processing section 30 performs tone correction on the basis of tone correction data (tone correction table) under the control of control section 100. In addition to the tone correction, the image processing section 30 also performs, on the input image data, various correction processing such as color correction and shading correction, compression processing, and the like. Image forming section 40 is controlled on the basis of the processed image data.

Image forming section 40 includes, for example, intermediate transfer unit 42 and image forming units 41Y, 41M, 41C, and 41K for forming images with color toners of respective Y, M, C, and K components on the basis of the input image data.

Image forming units 41Y, 41M, 41C, and 41K for respective Y, M, C, and K components have similar configurations. For convenience in illustration and description, common components are denoted by the same numerals, and such numerals are accompanied by Y, M, C, or K when they are to be distinguished. In FIG. 1, only constituent elements of the image forming unit 41Y for the Y component are denoted by numerals, and numerals for constituent elements of other image forming units 41M, 41C, and 41K are omitted.

Image forming unit 41 includes exposing device 411, developing device 412, photoconductor drum 413, charging device 414, drum cleaning device 415, and the like.

Photoconductor drum 413 is, for example, a negative-charging organic photoconductor (OPC) formed by successively laminating, on a peripheral surface of aluminum conductive cylinder (aluminum tube), an undercoat layer (UCL), a charge generation layer (CGL), and a charge transport layer (CU). The charge generation layer is formed from an organic semiconductor composed of a charge generation material (e.g., phthalocyanine pigment) dispersed in a resin binder (e.g., polycarbonate), and generates pairs of positive charges and negative charges upon exposure using exposing device 411. The charge transport layer is formed from a hole transport material (electron-donating nitrogen compound) dispersed in a resin binder (e.g., polycarbonate resin), and transports positive charges generated in the charge generation layer to a surface of the charge transport layer.

Control section 100 controls driving current supplied to a driving motor (not illustrated) that rotates photoconductor drum 413, whereby photoconductor drum 413 rotates at a constant peripheral speed.

Charging device 414 evenly and negatively charges the surface of photoconductive photoconductor drum 413. Exposing device 411 includes, for example, a semiconductor laser, and irradiates photoconductor drum 413 with laser light corresponding to an image of each color component. Positive charges are generated in the charge generation layer of photoconductor drum 413, and transported to the surface of the charge transport layer, thereby neutralizing surface charges (negative charges) of photoconductor drum 413. Electrostatic latent images of respective color components are formed on the surface of photoconductor drums 413, respectively, due to potential differences from the surroundings.

Developing device 412 is, for example, a developing device of a two-component developing system, and forms a toner image by attaching a toner of each color component to the surface of each photoconductor drum 413 to visualize the electrostatic latent image.

Drum cleaning device 415 includes a drum cleaning blade and the like to be in sliding contact with the surface of photoconductor drum 413, and removes residual toner remaining on the surface of photoconductor drum 413 after the primary transfer.

The intermediate transfer unit 42 includes the intermediate transfer belt 421, a primary transfer roller 422, a plurality of support rollers 423, secondary transfer roller 424, belt cleaning device 426, and the like.

Intermediate transfer belt 421 includes an endless belt, and looped around the plurality of support rollers 423 under tension. At least one of the plurality of support rollers 423 is a driving roller, and the rest are driven rollers. For example, roller 423A, which is disposed downstream of primary transfer roller 422 for the K component in the running direction of the belt, is preferably a driving roller. This facilitates the retention of a constant running speed of the belt in a primary transfer section. Intermediate transfer belt 421 runs at a constant speed in the direction of arrow A by driving roller 423A being rotated.

Primary transfer roller 422 is disposed facing photoconductor drum 413 for each color component on the inner peripheral surface side of intermediate transfer belt 421. A primary transfer nip, which is for transferring a toner image from photoconductor drum 413 to intermediate transfer belt 421, is formed by firmly pressing primary transfer roller 422 onto photoconductor drum 413 with intermediate transfer belt 421 interposed therebetween.

Secondary transfer roller 424 is disposed on the outer peripheral surface side of intermediate transfer belt 421 while facing backup roller 423B disposed downstream of driving roller 423A in the running direction of the belt. A secondary transfer nip, which is for transferring a toner image from intermediate transfer belt 421 to paper sheet S, is formed by firmly pressing secondary transfer roller 424 onto backup roller 423B with intermediate transfer belt 421 interposed therebetween.

When intermediate transfer belt 421 passes through the primary transfer nip, toner images on photoconductor drums 413 are successively superimposed and transferred to intermediate transfer belt 421 (primary transfer). Specifically, primary transfer bias is applied to primary transfer roller 422 to impart an charge with polarity opposite to that of toners to the rear surface side of intermediate transfer belt 421 (side in contact with primary transfer roller 422), thereby electrostatically transferring the toner image to intermediate transfer belt 421.

Subsequently, during paper sheet S passing though the secondary transfer nip, the toner image on intermediate transfer belt 421 is transferred to the paper sheet S (secondary transfer). Specifically, secondary transfer bias is applied to secondary transfer roller 424 to impart an charge with polarity opposite to that of toners to the rear surface side of the paper sheet S (side in contact with secondary transfer roller 424), thereby electrostatically transferring the toner image to paper sheet S. The paper sheet S bearing the transferred toner image is conveyed to fixing section 60.

Belt cleaning device 426 includes a belt cleaning blade and the like to be in sliding contact with the surface of intermediate transfer belt 421, and removes residual toner remaining on the surface of intermediate transfer belt 421 after the secondary transfer. In place of secondary transfer roller 424, a configuration in which a secondary transfer belt is looped around a plurality of support rollers including a secondary transfer roller under tension (what is called belt-type secondary transfer unit) may be employed.

Fixing section 60 includes upper-side pressure roller 63 disposed on a fixing surface (surface on which the toner image is formed) of paper sheet S, a lower-side pressure roller 65 disposed on the rear surface (surface opposite to the fixing surface) of paper sheet S, heat source 60C, and the like. The fixing nip that grips and conveys paper sheet S is formed by firmly pressing lower-side pressure roller 65 onto upper-side pressure roller 63.

Fixing section 60 heats and presses the conveyed paper sheet S on which the toner image has been transferred (secondary transfer) at the fixing nip, thereby fixing the toner image on the paper sheet S. Fixing section 60 is disposed inside fixing device F as a unit. Details of fixing section 60 will be described later.

Sheet conveying section 50 includes sheet feeding section 51, sheet ejection section 52, conveying path section 53, and the like. Three sheet feeding tray units 51*a* to 51*c* included in sheet feeding section 51 store paper sheets S classified on the basis of weight, size, and the like in accordance with predetermined types. Conveying path section 53 includes a plurality of pairs of conveying rollers such as registration roller pair 53*a*.

Paper sheets S stored in sheet feeding tray units 51*a* to 51*c* are sent out from the topmost part one by one, and conveyed to image forming section 40 through conveying path section 53. During this step, a registration roller section in which registration roller pair 53*a* is disposed corrects the tilt of paper sheet S fed and adjusts the timing of conveyance. The toner image on intermediate transfer belt 421 is then simultaneously transferred to one of the surfaces of paper sheet S in image forming section 40 (second transfer), and a fixing step is performed in fixing section 60. Paper sheet S bearing the formed image is ejected outside the apparatus by sheet ejection section 52 provided with ejection roller 52*a*.

Figure 3:
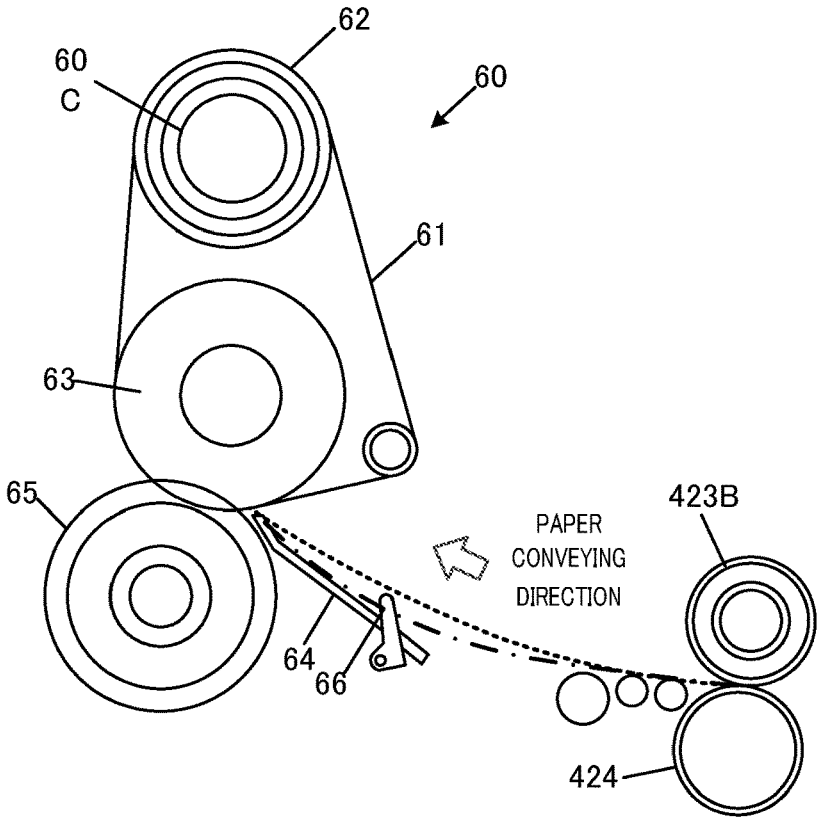
FIG. 3 is a view schematically illustrating a configuration of a fixing section.

Next, a configuration of fixing section 60 will be described with reference to FIG. 3. FIG. 3 is a view schematically illustrating the configuration of fixing section 60. In FIG. 3, the direction perpendicular to the paper surface is referred to as a width direction, and the front side is referred to as a "left end side" or a "left side", and the back side is referred to as a "right end side" or a "right side" at times. Fixing section 60 and control section 100 function as a fixing device. Fixing section 60 and control section 100 may be configured as a unit and attached to image forming apparatus 1, or may be separately incorporated in the image forming apparatus 1 to function as a fixing device.

Fixing section 60 includes endless fixing belt 61, heating roller 62, upper-side pressure roller 63, lower-side pressure roller 65, distortion detection section 66, and conveying speed change section 67.

Fixing belt 61 is wound around heating roller 62 and upper-side pressure roller 63. Fixing belt 61 contacts paper sheet S on which the toner image is formed, and thermally fixes the toner image on paper sheet S.

Heating roller 62 applies heat to fixing belt 61. Heating roller 62 incorporates heat source 60C that is, for example, a halogen heater for heating fixing belt 61. The outer peripheral surface of a cylindrical mandrel made of aluminum or the like is covered with a resin layer coated with PTFE to form heating roller 62.

Lower-side pressure roller 65 is driven and rotated by drive shaft 65A (see FIG. 5) in fixing section 60. The lower-side pressure roller 65 is pressed against upper-side pressure roller 63 via fixing belt 61. Paper sheet S is conveyed by driving force of lower-side pressure roller 65 and the driving force transmitted from lower-side pressure roller 65 to fixing belt 61.

Figure 4:
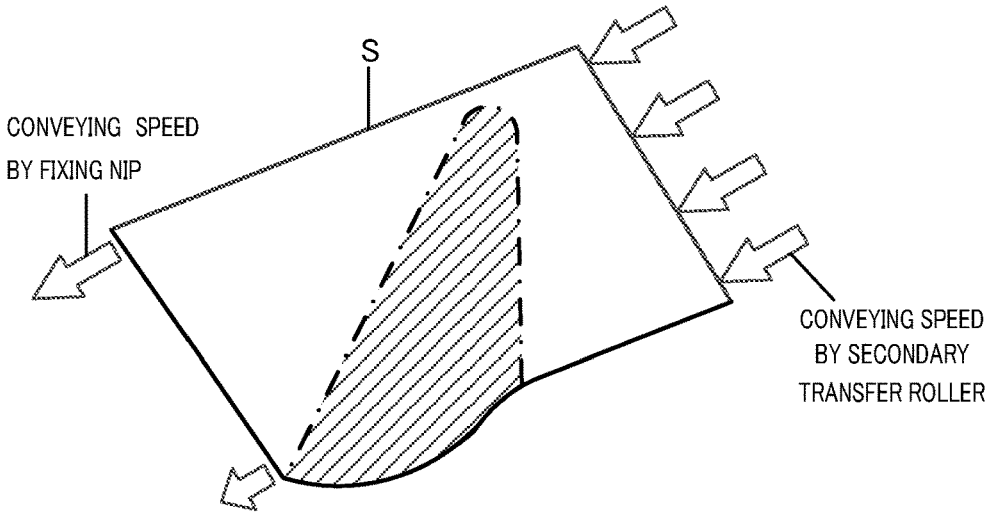
FIG. 4 is an explanatory view of a paper sheet in a case where a one-sided loop is generated.

As illustrated in FIG. 3, paper sheet S is conveyed from secondary transfer roller 424 toward the fixing nip in fixing section 60. In a case where a distance between secondary transfer roller 424 and the fixing nip is shorter than a length of paper sheet S in the conveying direction, when a leading edge of paper sheet S enters the fixing nip in a tilted state, the conveying speed of paper sheet S by the fixing nip becomes large at one end portion in the width direction of paper sheet S, and becomes small at the other end portion in the width direction of paper sheet S so that the conveying speed in the width direction does not become uniform. Further, the conveying speed of paper sheet S by secondary transfer roller 424 is uniform in the width direction (see FIG. 4). As a result, a one-sided loop (distortion) in which the other side edge in the width direction of paper sheet S bends in a loop shape occurs. In a case where an axis of secondary transfer roller 424 and an axis of upper-side pressure roller 63 are not in parallel with each other, the conveying direction of paper sheet S with respect to secondary transfer roller 424 is different from the conveying direction of paper sheet S with respect to upper-side pressure roller 63. This causes the one-sided loop (distortion). In FIG. 3, paper sheet S on which the one-sided loop has occurred is indicated by an imaginary line, and paper sheet S on which no one-sided loop has occurred is indicated by a broken line. Hereinafter, the one-sided loop generated on the right side of paper sheet S in the paper conveying direction is referred to as a "right-sided loop", and the one-sided loop generated on the left side is referred to as a "left-sided loop". Further, the hatched portion in FIG. 4 is an indentation bent in the back side of the paper surface, which is an exemplary left-sided loop generated on paper sheet S.

As illustrated in FIG. 3, a plurality of distortion detection sections 66 are disposed in the width direction on guide plate 64 downstream of the fixing nip in the paper conveying direction. Distortion detection section 66 includes an actuator, and detects the one-sided loop by the actuator being pushed by the one-sided loop. In FIG. 3, the distortion detection section 66 disposed on the front side (left end side) of the paper surface detects the right-sided loop when a pushed amount (loop amount) of the actuator exceeds a predetermined amount. Further, in FIG. 3, distortion detection section 66 disposed on the back side (right end side) of the paper surface detects the left-sided loop when the pushed amount (loop amount) of the actuator exceeds the predetermined amount.

Figure 5:
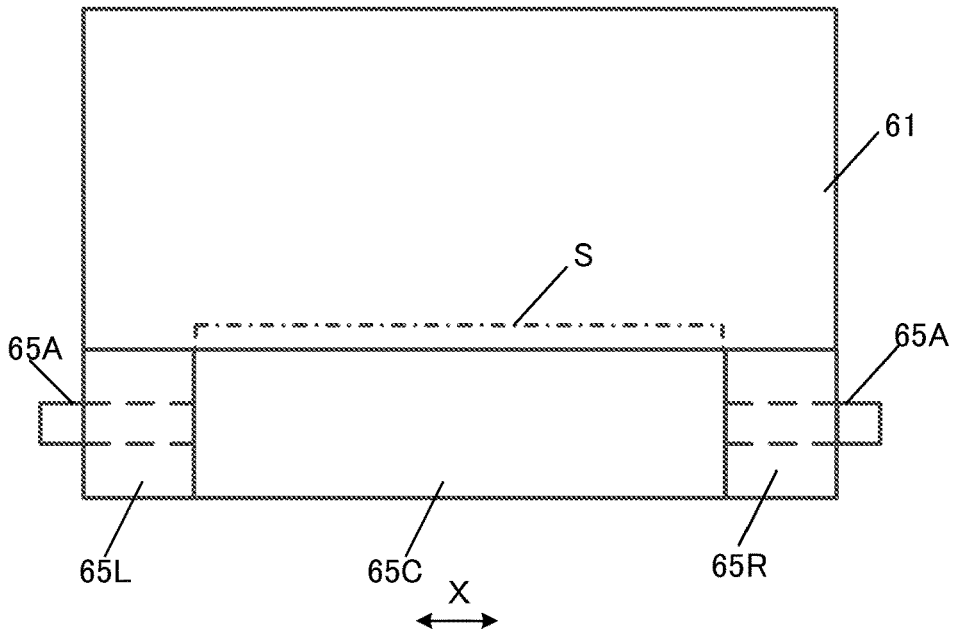
FIG. 5 is a view with an arrow in a case where a lower-side pressure roller is viewed in a paper conveying direction.
Figure 6:
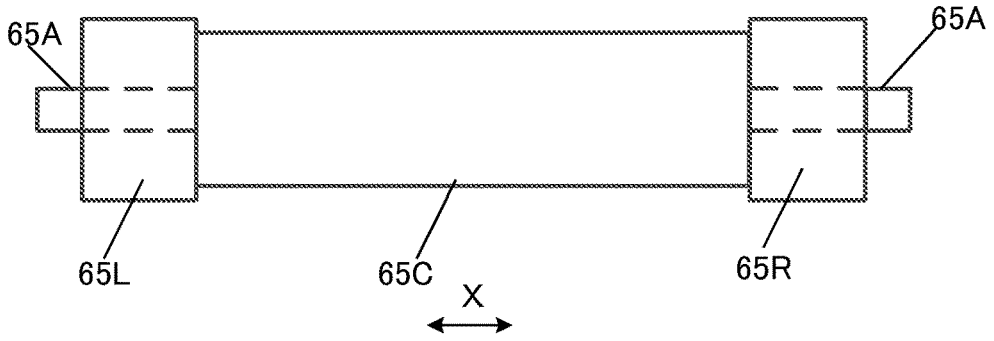
FIG. 6 is another view with an arrow in the case where the lower-side pressure roller is viewed in the paper conveying direction.

FIGS. 5 and 6 are views with arrows in a case where lower-side pressure roller 65 is viewed in the paper conveying direction. In FIGS. 5 and 6, width direction X orthogonal to the paper conveying direction is illustrated.

As illustrated in FIG. 5, lower-side pressure roller 65 is divided in width direction X. Lower-side pressure roller 65 includes center pressure roller 65C disposed at the center portion in width direction X, left-end pressure roller 65L disposed at the left end portion in width direction X, and right-end pressure roller 65R disposed at the right end portion in width direction X. As the imaginary line illustrates paper sheet S in FIG. 5, left-end pressure roller 65L and right-end pressure roller 65R are disposed outside the range to which paper sheet S is conveyed and at a position that contacts fixing belt 61 when paper sheet S is conveyed.

Center pressure roller 65C is connected to the drive shaft 65A. Left-end pressure roller 65L and right-end pressure roller 65R are supported to rotate around drive shaft 65A.

As illustrated in FIG. 6, an outer diameter of left-end pressure roller 65L is larger than an outer diameter of center pressure roller 65C. An outer diameter of right-end pressure roller 65R is larger than the outer diameter of center pressure roller 65C.

Figure 7:
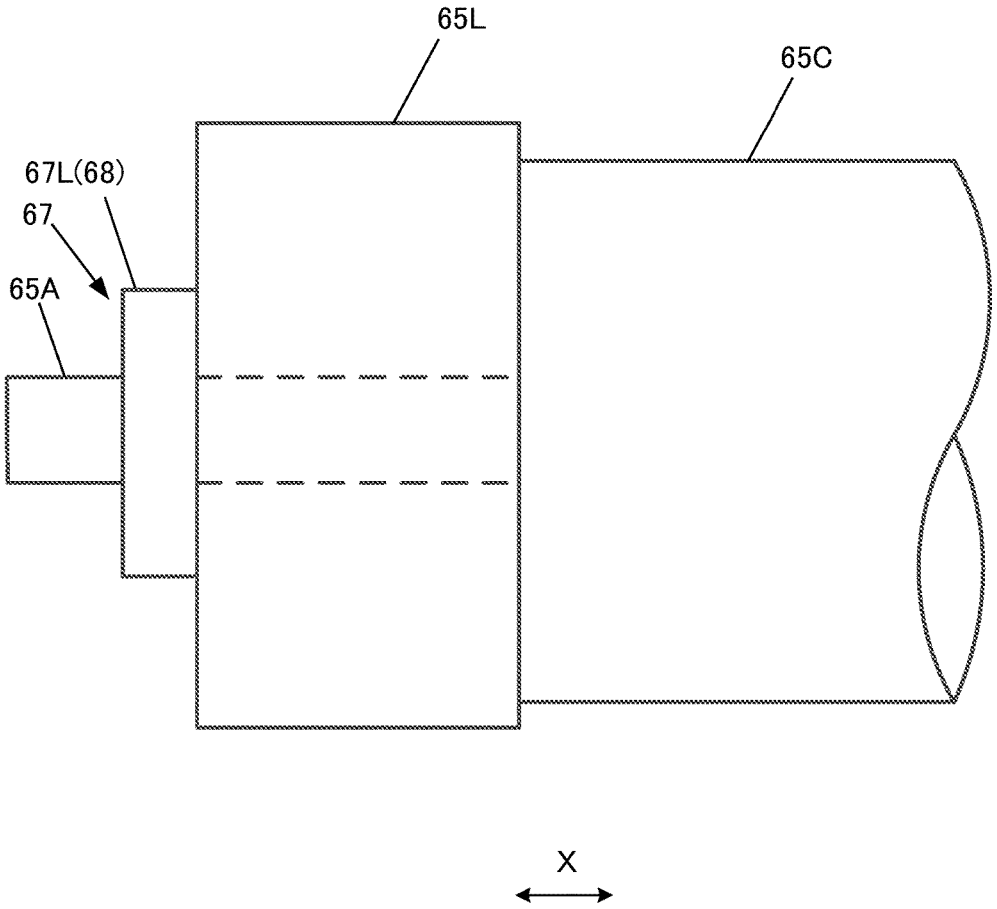
FIG. 7 is a view schematically illustrating a conveying speed change section.

FIG. 7 is a view schematically illustrating conveying speed change section 67. As illustrated in FIG. 7, conveying speed change section 67L is disposed at the left end portion of lower-side pressure roller 65 in width direction X.

Conveying speed change section 67L includes electromagnetic clutch 68. Electromagnetic clutch 68 is provided integrally with left-end pressure roller 65L. Electromagnetic clutch 68 connects drive shaft 65A and left-end pressure roller 65L by energization and releases the connection between drive shaft 65A and left-end pressure roller 65L by deenergization. When electromagnetic clutch 68 connects drive shaft 65A and left-end pressure roller 65L, left-end pressure roller 65L is driven and the driving force is transmitted from left-end pressure roller 65L to fixing belt 61. On the other hand, when electromagnetic clutch 68 releases the connection between drive shaft 65A and left-end pressure roller 65L, left-end pressure roller 65L is not driven and the driving force is not transmitted from left-end pressure roller 65L to fixing belt 61. Control section 100 controls electromagnetic clutch 68 such that left-end pressure roller 65L is connected/disconnected to/from drive shaft 65A.

Figure 8:
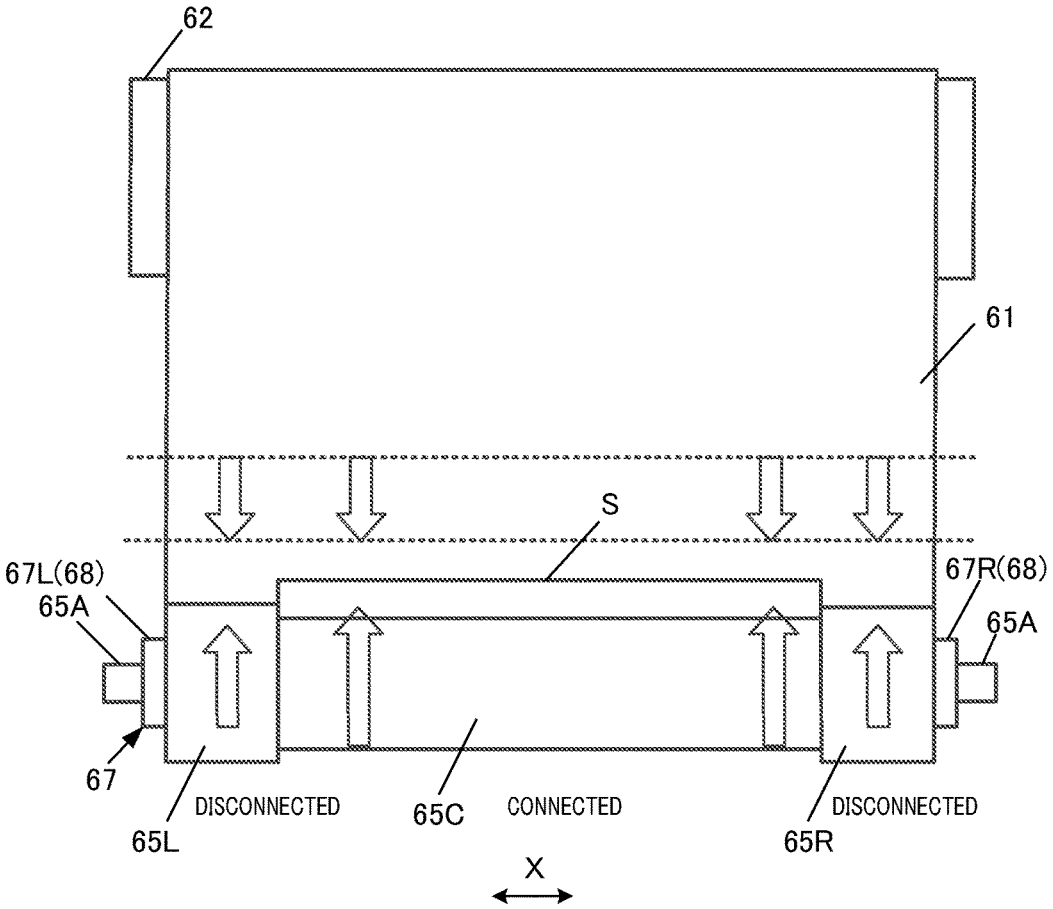
FIG. 8 is an explanatory view of the conveying speed change section in a case where the one-sided loop is not detected.

Although illustration is omitted in FIG. 7, conveying speed change section 67R is disposed at the right end portion of lower-side pressure roller 65 in width direction X (see FIG. 8). Conveying speed change section 67R includes electromagnetic clutch 68 that performs connection and release of the connection (disconnection) between drive shaft 65A and right-end pressure roller 65R. When electromagnetic clutch 68 connects drive shaft 65A and right-end pressure roller 65R, the driving force is transmitted from right-end pressure roller 65R to fixing belt 61. On the other hand, when electromagnetic clutch 68 releases the connection between drive shaft 65A and right-end pressure roller 65R, right-end pressure roller 65R is not driven and the driving force is not transmitted from right-end pressure roller 65R to fixing belt 61. Control section 100 controls electromagnetic clutch 68 such that right-end pressure roller 65R is connected/disconnected to/from drive shaft 65A.

Figure 9:
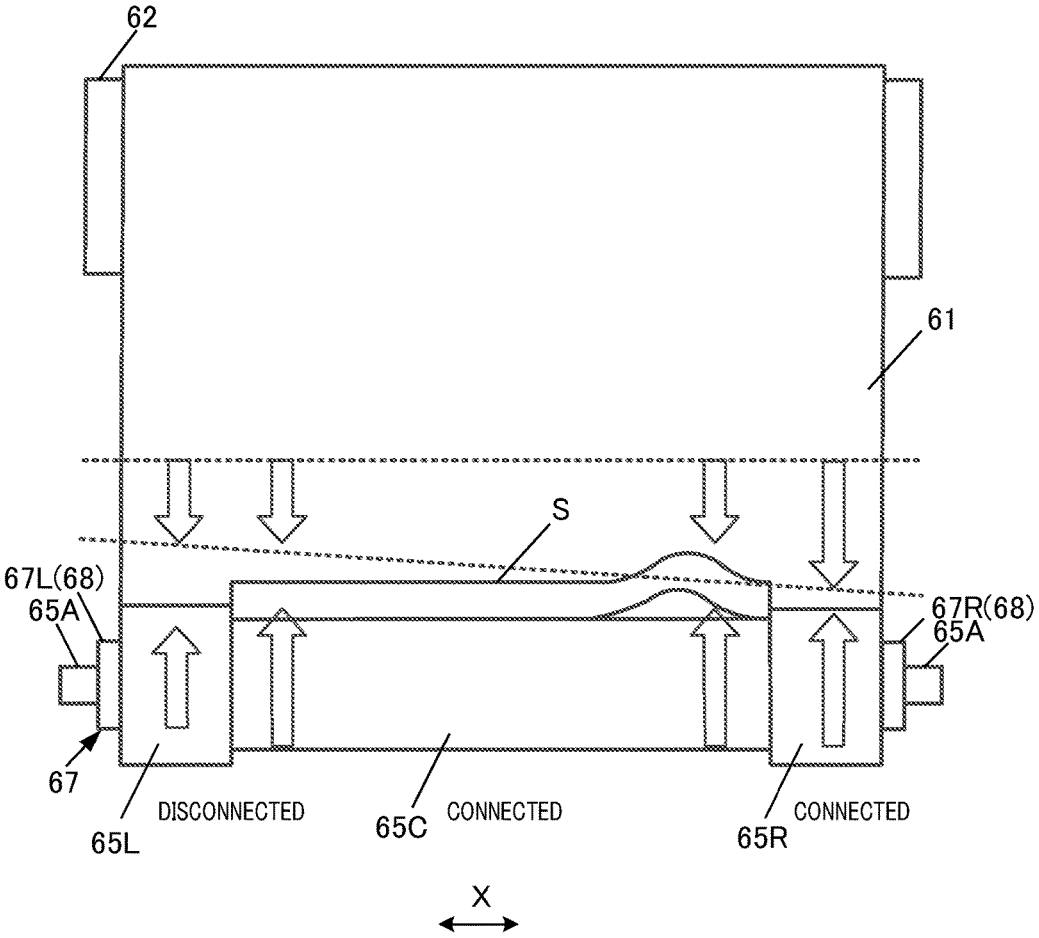
FIG. 9 is an explanatory view of the conveying speed change section in a case where a right-sided loop is detected.

Next, conveying speed change section 67 will be described in detail with reference to FIGS. 8 and 9. FIG. 8 is an explanatory view of conveying speed change section 67 in a case where the one-sided loop is not detected. FIG. 9 is an explanatory view of conveying speed change section 67 in a case where the right-sided loop is detected. In FIGS. 8 and 9, the magnitude of the conveying speed of paper sheet S by lower-side pressure roller 65 and the magnitude of the conveying speed of paper sheet S by fixing belt 61 are indicated by the size of the arrows.

First, a case where the conveying speed of paper sheet S entering the fixing nip is uniform in width direction X will be described with reference to FIG. 8. In the case where the conveying speed of paper sheet S entering the fixing nip is uniform in width direction X, the one-sided loop is not detected.

In the case where the one-sided loop is not detected, control section 100 controls electromagnetic clutch 68 such that left-end pressure roller 65L is not connected to drive shaft 65A. Further, control section 100 controls electromagnetic clutch 68 such that right-end pressure roller 65R is not connected to drive shaft 65A. In this case, driving force of the drive shaft 65A is transmitted from center pressure roller 65C to the center portion of fixing belt 61 in the width direction. At this time, since the driving force is not transmitted from left-end pressure roller 65L and right-end pressure roller 65R to the end portion of fixing belt 61 in the width direction, the end portion of fixing belt 61 in the width direction is driven at the speed same as that of the center portion of fixing belt 61 in the width direction facing center pressure roller 65C. Accordingly, as illustrated in FIG. 8, the conveying speed of paper sheet S by fixing belt 61 becomes uniform in width direction X, whereby paper sheet S is conveyed at the conveying speed uniform in width direction X at the center portion of center pressure roller 65C and fixing belt 61 in the width direction. In the case where the one-sided loop is not detected, right-end pressure roller 65R (left-end pressure roller 65L) does not contact paper sheet S outside the paper passing range at the time of paper passing. As a result, right-end pressure roller 65R (left-end pressure roller 65L) follows the end portion of fixing belt 61 in the width direction, whereby no problem will be caused even when the conveying speed of right-end pressure roller 65R or the like becomes lower than the conveying speed of center pressure roller 65C.

Next, a case where the conveying speed of paper sheet S entering the fixing nip is not uniform in width direction X will be described with reference to FIG. 9. In the case where the conveying speed of paper sheet S entering the fixing nip is not uniform in width direction X, the one-sided loop is detected. As an example, a case where the right-sided loop is detected will be described.

In the case where the right-sided loop is detected, control section 100 controls electromagnetic clutch 68 such that right-end pressure roller 65R is connected to drive shaft 65A. Meanwhile, control section 100 controls electromagnetic clutch 68 such that left-end pressure roller 65L is not connected to drive shaft 65A. In this case, the driving force of drive shaft 65A is transmitted from center pressure roller 65C to the center portion of fixing belt 61 in the width direction. Further, the driving force of drive shaft 65A is transmitted from right-end pressure roller 65R to the right end portion of fixing belt 61 in the width direction. The driving force is not transmitted from left-end pressure roller 65L to the left end portion of fixing belt 61 in the width direction. Since the outer diameter of right-end pressure roller 65R is larger than the outer diameter of center pressure roller 65C, a peripheral speed of right-end pressure roller 65R is larger than a peripheral speed of center pressure roller 65C. Accordingly, the right end portion of fixing belt 61 in the width direction facing right-end pressure roller 65R is driven at a higher speed than that of the center portion of fixing belt 61 in the width direction facing center pressure roller 65C. As a result, as illustrated in FIG. 9, the conveying speed of paper sheet S by fixing belt 61 is deviated in width direction X (large on the right side in the width direction, and small on the left side in the width direction), and the conveying speed of paper sheet S on the right side edge becomes larger than the conveying speed of the left side edge, whereby the right-sided loop is reduced and eliminated. In the case where the right-sided loop is eliminated (right-sided loop is not detected), control section 100 controls electromagnetic clutch 68 such that right-end pressure roller 65R is not connected to the drive shaft 65A.

Figure 10:
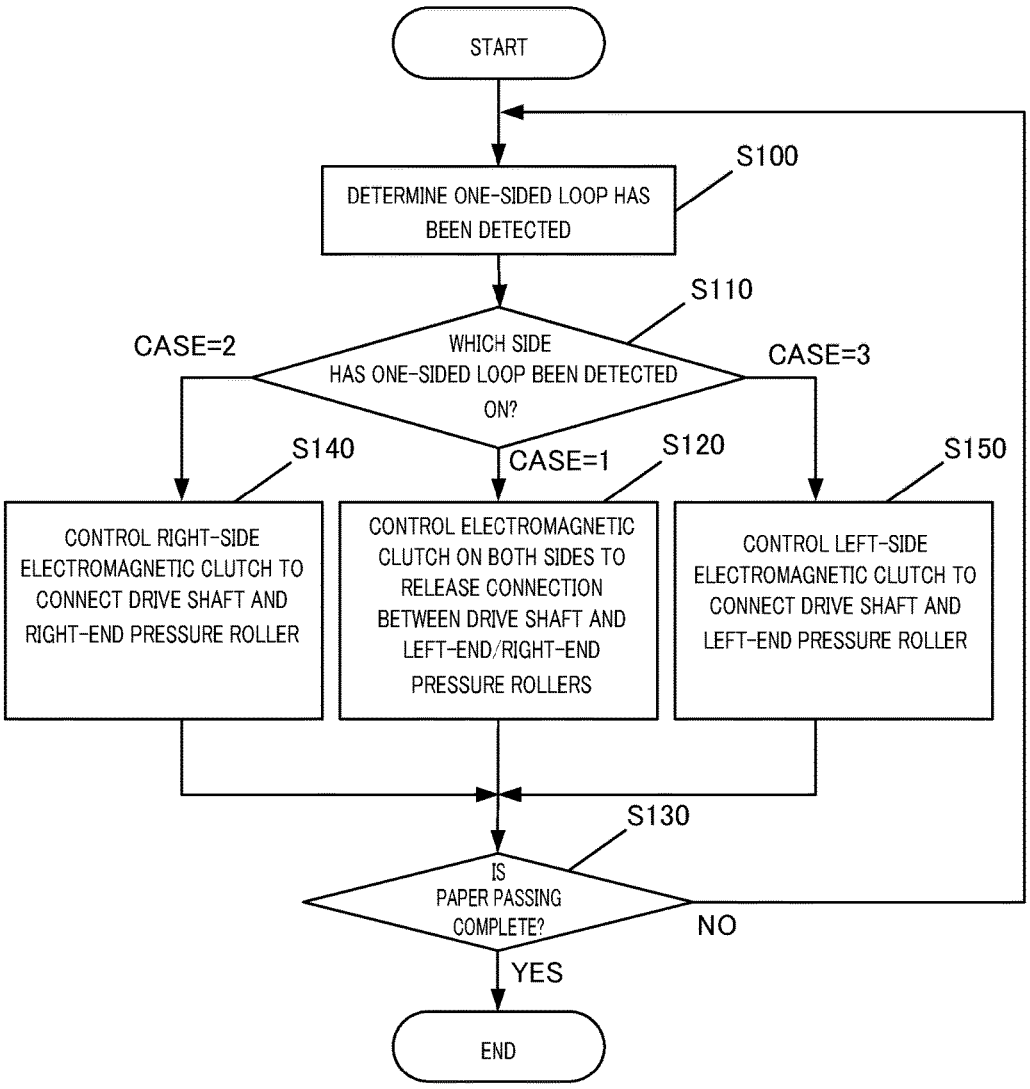
FIG. 10 is a flowchart illustrating switching processing of a paper conveying speed.

Next, switching processing of the conveying speed of paper sheet S will be described with reference to FIG. 10. FIG. 10 is a flowchart illustrating the switching processing of the conveying speed of paper sheet S. The present flow starts when paper sheet S is conveyed from secondary transfer roller 424 toward fixing section 60 (at the time of paper passing).

In step S100, control section 100 determines that the one-sided loop has been detected on the basis of a detection result of distortion detection section 66.

Then, in step S110, control section 100 determines which side of paper sheet S the one-sided loop has been detected on.

When the one-sided loop is on neither side of paper sheet S (CASE=1 in step S110), control section 100 controls electromagnetic clutch 68 on the left and right sides so that the connection between drive shaft 65A and left-end pressure roller 65L is released and also the connection between drive shaft 65A and right-end pressure roller 65R is released (step S120).

Subsequently, in step S130, control section 100 determines whether the paper passing is complete. When the paper passing is complete (Yes in step S130), the process is terminated. When the paper passing is not complete (No in step S130), the process proceeds to step S100.

When the one-sided loop is generated on the right side of the paper sheet S (CASE=2 in step S110), control section 100 controls electromagnetic clutch 68 on the right side to connect drive shaft 65A and right-end pressure roller 65R (step S140). Subsequently, the process proceeds to step S130.

When the one-sided loop is generated on the left side of paper sheet S (CASE=3 in step S110), control section 100 controls electromagnetic clutch 68 on the left side to connect drive shaft 65A and left-end pressure roller 65L (step S150). Subsequently, the process proceeds to step S130.

In the fixing device according to the embodiment described above, there are provided fixing belt 61, distortion detection section 66 that detects distortion of paper sheet S entering the fixing nip, conveying speed change section 67 that changes the conveying speed of fixing belt 61 in the width direction, and control section 100 that controls conveying speed change section 67 such that, when distortion is detected, the distortion is eliminated by changing conveying speed of the fixing belt 61 in the width direction. With this arrangement, when the one-sided loop is detected, control section 100 changes the conveying speed by fixing belt 61 to eliminate the distortion. As a result, the one-sided loop becomes small and the one-sided loop can be eliminated.

Next, a first variation of the present embodiment will be described. In the embodiment described above, conveying speed change section 67 includes drive shaft 65A and electromagnetic clutch 68. Center pressure roller 65C is connected to drive shaft 65A. For example, left-end pressure roller 65L is connected/disconnected to/from drive shaft 65A via electromagnetic clutch 68. Control section 100 controls electromagnetic clutch 68 such that left-end pressure roller 65L is connected/disconnected to/from drive shaft 65A.

Figure 11:
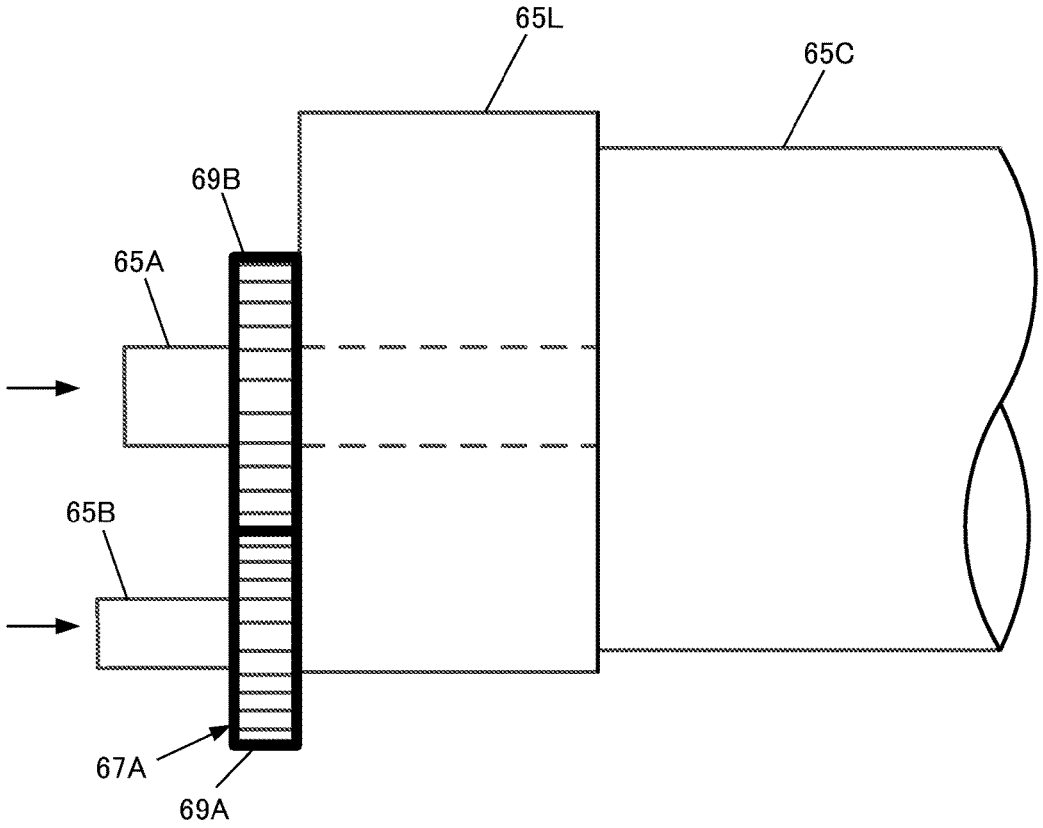
FIG. 11 is a view schematically illustrating a conveying speed change section according to a first variation.

FIG. 11 is a view schematically illustrating conveying speed change section 67A according to the first variation. Conveying speed change section 67A is provided on the left side and the right side of lower-side pressure roller 65. Hereinafter, conveying speed change section 67A on the left side will be described as a representative of conveying speed change section 67. In the first variation, as illustrated in FIG. 11, conveying speed change section 67A includes drive shaft 65A, drive shaft 65B, and a gear transmission mechanism having two gears 69A and 69B. Center pressure roller 65C is connected to drive shaft 65A. Gear 69A is connected to drive shaft 65B. Gear 69B is provided integrally with left-end pressure roller 65L. With this configuration, there are provided, in a mutually independent manner, a transmission path of the driving force transmitted from drive shaft 65A to center pressure roller 65C, and a transmission path of the driving force transmitted from drive shaft 65B to left-end pressure roller 65L via the gear transmission mechanism (gears 69A and 69B).

In the case where the one-sided loop is not detected, control section 100 rotates drive shaft 65A at a predetermined speed while stopping the rotation (non-rotating) of drive shaft 65B. Accordingly, the driving force of drive shaft 65A is transmitted from center pressure roller 65C to the center portion of fixing belt 61 in the width direction. At this time, since the driving force is not transmitted from left-end pressure roller 65L and right-end pressure roller 65R to the end portion of fixing belt 61 in the width direction, the left end portion of fixing belt 61 in the width direction is driven at the speed same as that of the center portion of fixing belt 61 in the width direction facing center pressure roller 65C. Further, the right end portion of fixing belt 61 in the width direction is also driven at the speed same as that of the center portion of fixing belt 61 in the width direction facing center pressure roller 65C. As a result, the conveying speed of paper sheet S by fixing belt 61 becomes uniform in the width direction, whereby paper sheet S is conveyed at the conveying speed uniform in the width direction at the center portion of center pressure roller 65C and fixing belt 61 in the width direction.

For example, in a case where the left-sided loop is detected, control section 100 rotates drive shaft 65B in conveying speed change section 67A on the left side at a predetermined speed. Accordingly, the driving force of drive shaft 65B is transmitted from left-end pressure roller 65L to fixing belt 61 via the gear transmission mechanism. At this time, since the outer diameter of left-end pressure roller 65L is larger than the outer diameter of center pressure roller 65C, the driving force of drive shaft 65B transmitted from left-end pressure roller 65L to the left end portion of fixing belt 61 in the width direction becomes larger than the driving force of drive shaft 65A transmitted from center pressure roller 65C to the center portion of fixing belt 61 in the width direction. As a result, the conveying speed of the left end portion of fixing belt 61 in the width direction becomes larger than the conveying speed of the center portion of fixing belt 61 in the width direction. Further, the conveying speed of left-end pressure roller 65L becomes larger than the conveying speed of center pressure roller 65C. Accordingly, the left-sided loop is reduced and eliminated.

In the first variation, for example, control section 100 may change a relative rotation speed of drive shaft 65B relative to drive shaft 65A. Accordingly, the difference between the conveying speed of paper sheet S by center pressure roller 65C and the conveying speed of paper sheet S by left-end pressure roller 65L (or right-end pressure roller 65R) can be freely adjusted. Moreover, the difference between the conveying speed of paper sheet S by the center portion of fixing belt 61 in the width direction facing center pressure roller 65C and the conveying speed of paper sheet S by the end portion of fixing belt 61 in the width direction facing left-end pressure roller 65L (or right-end pressure roller 65R) can be freely adjusted. As a result, the one-sided loop can be eliminated depending on the loop amount.

Next, a second variation of the present embodiment will be described. In the embodiment described above, the outer diameter of left-end pressure roller 65L (right-end pressure roller 65R) is larger than the outer diameter of center pressure roller 65C. Accordingly, the peripheral speed of left-end pressure roller 65L (right-end pressure roller 65R) is made larger than the peripheral speed of center pressure roller 65C, and the conveying speed of paper sheet S by the end portion of fixing belt 61 in the width direction facing left-end pressure roller 65L (right-end pressure roller 65R) is made larger than the conveying speed of paper sheet S by the center portion of fixing belt 61 in the width direction facing center pressure roller 65C. As a result, the one-sided loop generated at one side edge of paper sheet S in the width direction is eliminated.

Figure 12A:
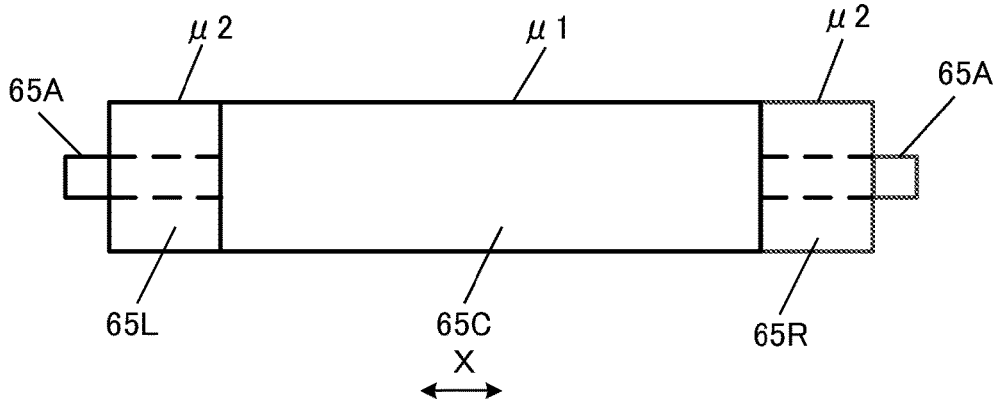
FIG. 12A is another view with an arrow in the case where the lower-side pressure roller is viewed in the paper conveying direction.
Figure 12B:
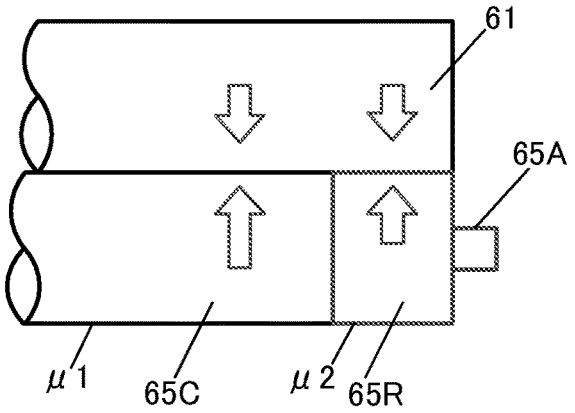
FIG. 12B is a partial view of FIG. 12A with arrows in the case where the one-sided loop is not detected.
Figure 12C:
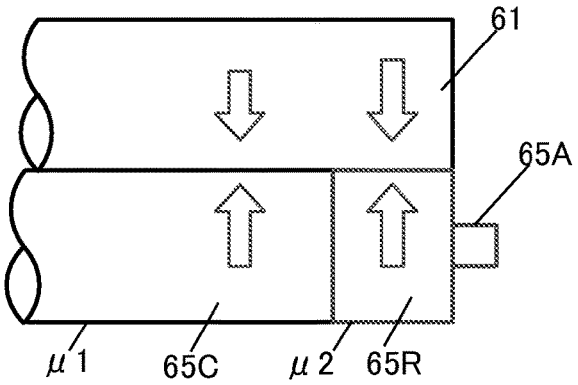
FIG. 12C is another partial view of FIG. 12A with arrows in a case where the one-sided loop is detected.

FIG. 12A is a view with an arrow in a case where lower-side pressure roller 65 according the second variation is viewed in the paper conveying direction. FIGS. 12B and 12C are partial views of FIG. 12A with arrows. In the second variation, as illustrated in FIG. 12A, the outer diameter of left-end pressure roller 65L (right-end pressure roller 65R) and the outer diameter of center pressure roller 65C are the same. A friction coefficient $\mu 2$ of left-end pressure roller 65L (right-end pressure roller 65R) is larger than a friction coefficient $\mu 1$ of center pressure roller 65C.

In FIG. 12B, the magnitude of the conveying speed of paper sheet S by lower-side pressure roller 65 and the magnitude of the conveying speed of the paper sheet S by fixing belt 61 in the case where the one-sided loop is not detected are indicated by the size of the arrows. In the case where the one-sided loop is not detected, control section 100 controls electromagnetic clutch 68 such that right-end pressure roller 65R (left-end pressure roller 65L) is disconnected from drive shaft 65A. Accordingly, the driving force is transmitted from center pressure roller 65C to the center portion of fixing belt 61 in the width direction. At this time, since the friction coefficient μ1 of center pressure roller 65C is relatively small, the center portion of fixing belt 61 in the width direction is driven at a speed slower than the conveying speed of center pressure roller 65C by a predetermined rate. Since the driving force is not transmitted from right-end pressure roller 65R to the end portion of fixing belt 61 in the width direction, the end portion of fixing belt 61 in the width direction is driven at the speed same as that of the center portion of fixing belt 61 in the width direction (see FIG. 12B). Accordingly, center pressure roller 65C and the center portion of fixing belt 61 in the width direction convey paper sheet S at the uniform conveying speed in the width direction. In the case where the one-sided loop is not detected, right-end pressure roller 65R (left-end pressure roller 65L) does not contact paper sheet S outside the paper passing range at the time of paper passing. As a result, right-end pressure roller 65R (left-end pressure roller 65L) follows the end portion of fixing belt 61 in the width direction, whereby no problem will be caused even when the conveying speed thereof becomes lower than the conveying speed of the center pressure roller 65C.

In FIG. 12C, the magnitude of the conveying speed of paper sheet S by lower-side pressure roller 65 and the magnitude of the conveying speed of paper sheet S by fixing belt 61 in the case where the right-sided loop is detected are indicated by the size of the arrows. In the case where the right-sided loop is detected, control section 100 controls electromagnetic clutch 68 such that right-end pressure roller 65R is connected to drive shaft 65A. Meanwhile, control section 100 controls electromagnetic clutch 68 such that left-end pressure roller 65L is disconnected from drive shaft 65A. In this case, the driving force of drive shaft 65A is transmitted from the center pressure roller 65C to the center portion of fixing belt 61 in the width direction. Further, the driving force of drive shaft 65A is transmitted from the right-end pressure roller 65R to the right end portion of fixing belt 61 in the width direction. The driving force is not transmitted from left-end pressure roller 65L to the left end portion of fixing belt 61 in the width direction. Since the friction coefficient μ2 of right-end pressure roller 65R is larger than the friction coefficient μ1 of center pressure roller 65C, the driving force transmitted from right-end pressure roller 65R to the right end portion of fixing belt 61 in the width direction is larger than the driving force transmitted from center pressure roller 65C to the center portion of fixing belt 61 in the width direction. Accordingly, even in a case where rotation speeds of center pressure roller 65C and right-end pressure roller 65R are the same, the right end portion of fixing belt 61 in the width direction facing right-end pressure roller 65R is driven at a speed higher than that of the center portion of fixing belt 61 in the width direction facing center pressure roller 65C (see FIG. 12B).

As a result, the conveying speed of paper sheet S by fixing belt 61 is deviated in the width direction (large on the right side in the width direction, and small on the left side in the width direction), and the conveying speed of paper sheet S on the right side edge becomes larger than the conveying speed of the left side edge, whereby the right-sided loop is reduced and eliminated.

Next, a third variation of the present embodiment will be described. In the embodiment described above, in the case where the one-sided loop is detected, conveying speed change section 67R is controlled so that right-end pressure roller 65R (left-end pressure roller 65L) rotates and the end portion of fixing belt 61 in the width direction facing right-end pressure roller 65R (left-end pressure roller 65L) is driven at a speed higher than that of the center portion of fixing belt 61 in the width direction. Therefore, deviation of fixing belt 61 occurs at times.

Figure 13A:
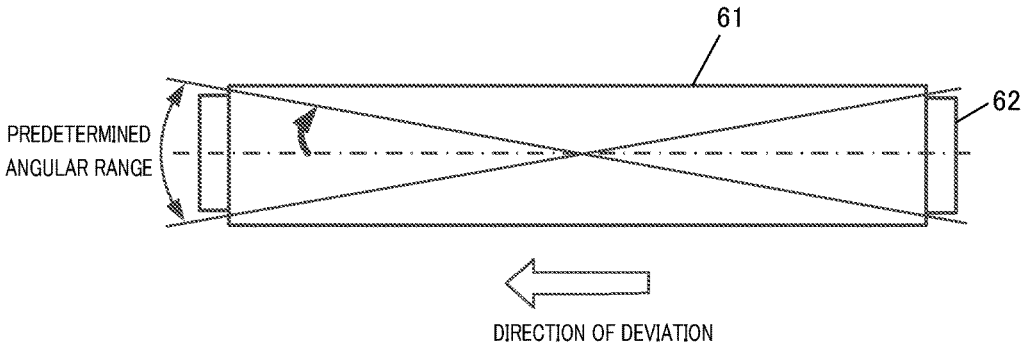
FIG. 13A is a view with arrows in a case where a heating roller is viewed from above.
Figure 13B:
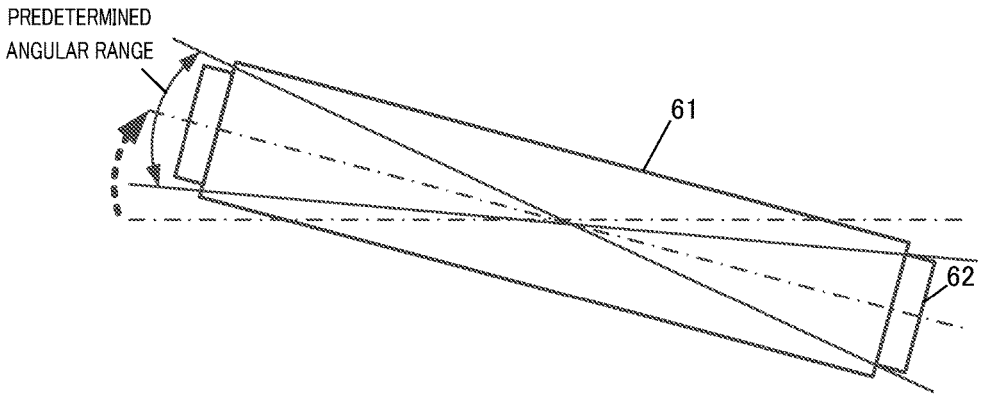
FIG. 13B is a view with arrows in the case where the heating roller is viewed from above.

FIGS. 13A and 13B are views with arrows in a case where heating roller 62 according to the third variation is viewed from above. As illustrated in FIG. 13A, a steering mechanism (not illustrated) that adjusts deviation of fixing belt 61 is provided. The steering mechanism rotates a rotation axis of heating roller 62 around the center portion in the width direction at a predetermined angular range. For example, in a case where the left-sided loop is detected and conveying speed change section 67L on the left side is controlled, control section 100 controls the steering mechanism such that the rotation axis of heating roller 62 rotates in the clockwise direction indicated by the solid line arrow in FIG. 13A relative to the direction of deviation of fixing belt 61 (left direction indicated by the hollow arrow in FIG. 13A). As a result, heating roller 62 moves away from the deviation of fixing belt 61, whereby a relative positional relationship between fixing belt 61 and heating roller 62 is kept constant.

Here, as illustrated in FIG. 13B, in a case where the left-sided loop tends to be detected, for example, a central axis of heating roller 62 is preferably tilted in advance by a predetermined angle in the clockwise direction as indicated by the broken line arrow in FIG. 13B.

It should be noted that, although distortion detection section 66 including the actuator is provided in the embodiment described above, the present invention is not limited to this, and a publicly known technique such as a laser displacement meter that detects a one-sided loop in a contactless manner using laser light may be used for distortion detection section 66.

Although embodiments of the present invention have been described and illustrated in detail, it is clearly understood that the same is by way of illustration and example only and not limitation, the scope of the present invention should be interpreted by terms of the appended claims.

What is claimed is:

1. A fixing device, comprising:

a fixing belt;

a distortion detector that detects distortion in which a magnitude of bending at one side edge in a width direction of a recording medium entering a fixing nip is different from a magnitude of bending at the other side edge in the width direction;

a conveying speed changer that changes a conveying speed of the fixing belt in the width direction relative to the recording medium; and a hardware processor that controls the conveying speed changer such that the conveying speed of the fixing belt in the width direction is changed to eliminate the distortion in a case where the distortion is detected.

2. The fixing device according to claim 1, further comprising:

a pressure roller disposed to face the fixing belt at the fixing nip, wherein the pressure roller includes a center pressure roller disposed at a center portion in the width direction, and an end pressure roller disposed at end portion in the width direction, and the conveying speed changer adjusts driving force transmitted from the end pressure roller to the fixing belt by switching at least driving and non-driving of the end pressure roller to change a conveying speed of the fixing belt in the width direction.

3. The fixing device according to claim 2, wherein the conveying speed changer selects at least one of a transmission path of driving force transmitted from the center pressure roller to the fixing belt and a transmission path of the driving force transmitted from the end pressure roller to the fixing belt, and performs switching of the conveying speed of the fixing belt between a first conveying speed uniform in the width direction and a second conveying speed in which the end portion in the width direction is larger than the center portion in the width direction, and the hardware processor controls the conveying speed changer such that, in a case where the distortion is detected due to the conveying speed at the end portion of the fixing belt being smaller than the conveying speed at the center portion of the fixing belt, the conveying speed of the fixing belt is switched from the first conveying speed to the second conveying speed to eliminate the distortion.

4. The fixing device according to claim 2, wherein in a case where the recording medium is conveyed, the end pressure roller is disposed at a position in contact with the fixing belt outside a range to which the recording medium is conveyed.

5. The fixing device according to claim 2, wherein an outer diameter of the end pressure roller is larger than an outer diameter of the center pressure roller.

6. The fixing device according to claim 2, wherein a friction coefficient of the end pressure roller is larger than a friction coefficient of the center pressure roller.

7. The fixing device according to claim 2, further comprising:

a drive shaft connected to the center pressure roller and connectable to the end pressure roller, wherein the conveying speed changer performs switching between connection and disconnection of the end pressure roller with respect to the drive shaft, and the hardware processor controls the conveying speed changer such that the end pressure roller is connected to the drive shaft in a case where the distortion is detected and the end pressure roller is disconnected from the drive shaft in a case where the distortion is not detected.

8. The fixing device according to claim 2, further comprising:

a first drive shaft connected to the center pressure roller; and a second drive shaft connected to the end pressure roller, wherein the conveying speed changer performs switching between rotating and non-rotating of the second drive shaft, and the hardware processor controls the conveying speed changer such that the second drive shaft is rotated in a case where the distortion is detected and the second drive shaft is non-rotated in a case where the distortion is not detected.

9. The fixing device according to claim 1, further comprising:

a belt steering mechanism that adjusts deviation of the fixing belt, wherein the hardware processor controls the belt steering mechanism such that deviation of the fixing belt is adjusted in a case where the distortion is detected and control is performed on the conveying speed changer such that the distortion is eliminated.

10. An image forming apparatus, comprising the fixing device according to claim 1.

* * * * *